US006200300B1

(12) United States Patent
Petriekis et al.

(10) Patent No.: US 6,200,300 B1
(45) Date of Patent: Mar. 13, 2001

(54) HANGABLE CONTAINER

(75) Inventors: Paul F. Petriekis, Palos Park; Michael Wilford, Downers Grove, both of IL (US)

(73) Assignee: David S. Smith Packaging Limited (GB)

( * ) Notice: Subject to any disclaimer, the term of this patent is extended or adjusted under 35 U.S.C. 154(b) by 0 days.

(21) Appl. No.: 09/195,322

(22) Filed: Nov. 18, 1998

(51) Int. Cl.[7] ..... A61B 19/00
(52) U.S. Cl. ..... 604/408; 206/219; 222/92
(58) Field of Search ..... 604/408, 411, 604/262; 206/219, 222; 128/DIG. 3; 383/219, 121, 121.1, 63; 222/92, 93, 95

(56) References Cited

U.S. PATENT DOCUMENTS

| | | | | |
|---|---|---|---|---|
| 2,838,046 | | 6/1958 | Butler . | |
| 3,924,781 | | 12/1975 | Witte . | |
| 3,930,286 | | 1/1976 | McGowen . | |
| 4,482,585 | * | 11/1984 | Ohodira et al. | 606/262 |
| 4,601,410 | | 7/1986 | Bond . | |
| 4,636,412 | * | 1/1987 | Field | 604/408 |
| 4,657,540 | * | 4/1987 | Iwamoto et al. | 604/408 |
| 4,778,699 | | 10/1988 | Knox, III et al. . | |
| 4,910,147 | * | 3/1990 | Bacehowski et al. | 604/408 |
| 5,195,987 | * | 3/1993 | Karpiak | 604/262 |
| 5,259,844 | * | 11/1993 | Bilstad et al. | 604/403 |
| 5,334,180 | | 8/1994 | Adolf et al. . | |
| 5,514,106 | * | 5/1996 | D'Silva | 604/408 |
| 5,647,511 | | 7/1997 | Bond . | |
| 5,690,253 | | 11/1997 | LaFleur . | |
| 5,743,435 | | 4/1998 | Tomic . | |
| 5,749,493 | | 5/1998 | Boone et al. . | |
| 5,910,138 | * | 6/1999 | Sperko et al. | 604/408 |
| 5,941,866 | * | 8/1999 | Niedospial, Jr. | 604/408 |

FOREIGN PATENT DOCUMENTS

| | | |
|---|---|---|
| 2111944 | 7/1983 | (GB) . |
| 02255147 | 10/1990 | (JP) . |
| WO 91/10604 | 7/1991 | (WO) . |
| WO 94/00363 | 1/1994 | (WO) . |

* cited by examiner

*Primary Examiner*—John G. Weiss
*Assistant Examiner*—David J. Cho
(74) *Attorney, Agent, or Firm*—Wallenstein & Wagner, Ltd.

(57) ABSTRACT

A hangable bag used for containing and dispensing product including a first panel and a second panel heat sealed together at adjacent seal areas to form an interior compartment therebetween. A spout is sealed to the first panel to provide access to the interior compartment for filling and dispensing product from the bag. A first of the seal areas forms a handle region with an aperture therethrough, and has a substantially greater width than the other seal areas to provide increased strength and rigidity to the handle region of the hangable bag.

19 Claims, 4 Drawing Sheets

HANGABLE CONTAINER

TECHNICAL FIELD

The present invention relates generally to collapsible bags and, more particularly, to collapsible bags having a means for carrying or hanging the bag.

BACKGROUND OF THE INVENTION

Collapsible plastic bags are often used to store liquid products such as chemicals, soft drink syrup, and food condiments. The plastic bags are typically housed in a container or box to aid in handling and dispensing of the product. Such bags are referred to in the art as "bag-in-box bags."

The plastic bags also have a spout for filling and dispensing the product within the bag. Generally, to dispense product from bag-in-box bags, vacuum pump systems are often utilized. To aid in dispensing product from the container, evacuation channels are often placed within the bag. Evacuation channels are typically elongated cylindrical tubes or strips of protruding ribs having a sufficient height. One end of the evacuation channel is disposed transverse to, or is connected to the spout, and the other end of the evacuation channel extends into the cavity of the bag. As the bag is emptied by the force of the vacuum pump, portions of the bag collapse unevenly, tending to leave pockets of product, typically liquid, which may become isolated from the rest of the liquid in the container. The evacuation channel, however, forms a conduit which cannot be closed off by the vacuum pressure on the walls of the bag. In this manner the entire chamber of the flexible bag remains in communication with the spout at all times during the dispensing such that all product within the bag can be removed.

With many applications, typically in the chemical and food arenas, the bag-in-box bag cannot be placed at the exact location where the product is needed due to health/bacterial/sanitization and logistic concerns. Thus, the vacuum pump system in connection with the dip strip helps to fully drain the bag, in addition to pumping the product from the bag-in-box bag to the desired end location, such location that is typically a distance away from the area where the bag-in-box bag is stored.

Because a container or box is required to house the "bag-in-box" bag, the overall bag-in-box is more expensive to manufacture than a bag without a box. A similar dilemma is observed with the requirement of a dip strip. Additionally, because a pump system is required to remove product from the bag and direct product to the desired location for use, the bag-in-box bag is often more complex and costly to operate.

As a result, several designs have been created in an attempt to eliminate the need for both the containing box, the vacuum pump draining system, and the evacuation channels. One such design is disclosed in U.S. Pat. No. 2,838,046 (the '046 patent), issued to W. F. Butler. The '046 patent discloses a container including a transverse support member having a wire hook secured thereto, such that the container may be supported in use. While this disclosure eliminates the need for a containing box, it unnecessarily requires the addition of a support member and a wire hook. Therefore, the device of the '046 patent does not solve the problem of increased manufacturing time and cost involved with the bag-in-box bags.

Other devices for supporting a bag for dispensing product from the bag are disclosed in U.S. Pat. No. 3,924,781 (the '781 patent) issued to Witte, and U.S. Pat. No. 5,690,253 (the '253 patent) issued to LaFleur. The '781 patent discloses a device having a rigid support rod which extends through openings in the container at opposing side wall portions, to support the container. A complex hanger bar and connecting web axial to the support rod engages and supports the rod. Finally, the connecting web is hung from an overhead pulley and cable system. The '253 patent discloses a bulk-liquid bag having a pair of lift straps formed by the top wall of the bag. Lift arms are then hooked under the associated pair of lift straps and are hoisted upward and suspended from an overhead hoist or floor crane. Both the '781 patent and the '253 patent utilize elaborate hanging mechanisms which increase the complexity, bulkiness, and overall cost of the device, and, therefore, do not solve the problems of the previous devices.

Accordingly, a collapsible hangable bag in accordance with the present invention provides an inexpensive and simple solution to eliminate the drawbacks of the prior dispensing bags described above.

SUMMARY OF THE INVENTION

The hangable bag of the present invention is adapted to be utilized for containing and dispensing a liquid, and includes a frontal panel, a rearward panel, a spout, and a plurality of seal areas. The seal areas include portions of the frontal and rearward panels which are heat sealed together to form an enclosed region. A first of the seal areas forms an enlarged handle region and extends opposite the enclosed region a distance substantially greater than the other seal areas. Typically, the ratio of the width of the first seal area as compared to the width of the other seal areas is in the range of 20 to 10. The enlarged handle region of the first seal area has a substantially greater rigidity than the other seal areas. At least one aperture extends through the handle region and provides a means for hanging and carrying the bag.

According to another aspect of the present invention, a plurality of layers of material form each of the frontal and rearward panels. As such, the seal areas include portions of each layer of material which are reformed into substantially integrated structures. The seal areas are generally inseparable into their constituent layers due to the welding nature of the heat and pressure on the plastic bag materials. The integrated structure of the seal area has a density substantially greater than the density of the adjacent individual layers.

According to another aspect of the present invention, the spout is heat sealed to one of the bag panels. The spout has an axis which is substantially perpendicular to the bag panels, and a spout opening which provides access to the interior compartment of the enclosed region.

According to another aspect of the present invention, the collapsible bag can be carried with, and hung from the apertures in the rigid handle region. By hanging the bag, the contents thereof are dispensed via gravity flow through the spout. No additional structure or elements are required (i.e., there is no need for a containing box, evacuation channels, or a vacuum pump). Because the bag can be hung from apertures in its handle region, the bag provides a sterile and bacterial free component which can be placed directly in the area of use. Thus, the hangable bag of the present invention provides a collapsible bag which is inexpensive to manufacture, easy to use, and which overcomes all of the aforementioned inadequacies of previous collapsible bag systems.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
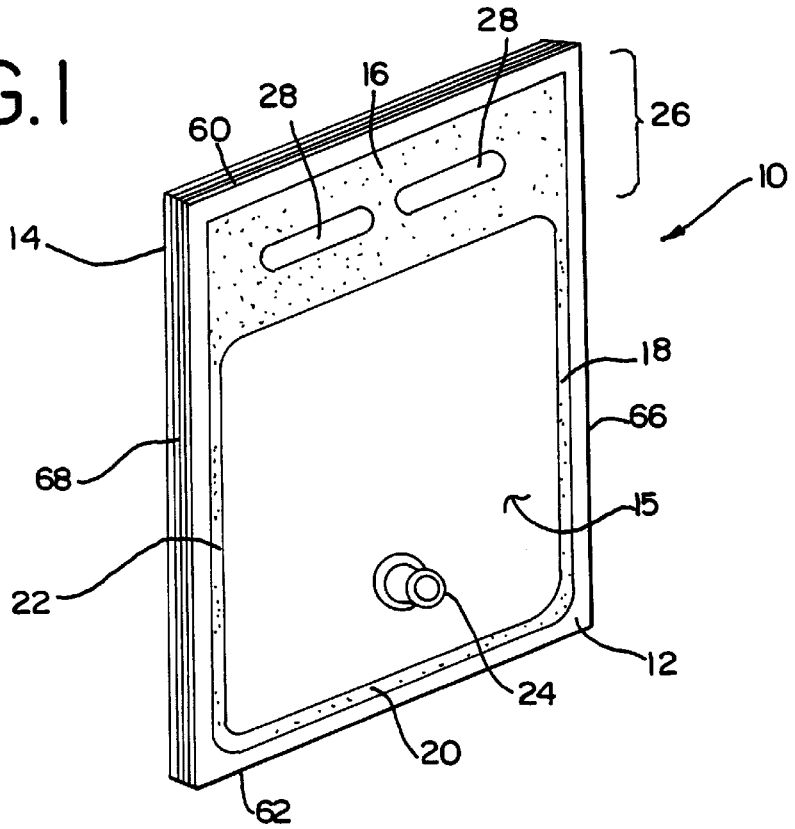
FIG. 1 is a perspective view of a hangable bag of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
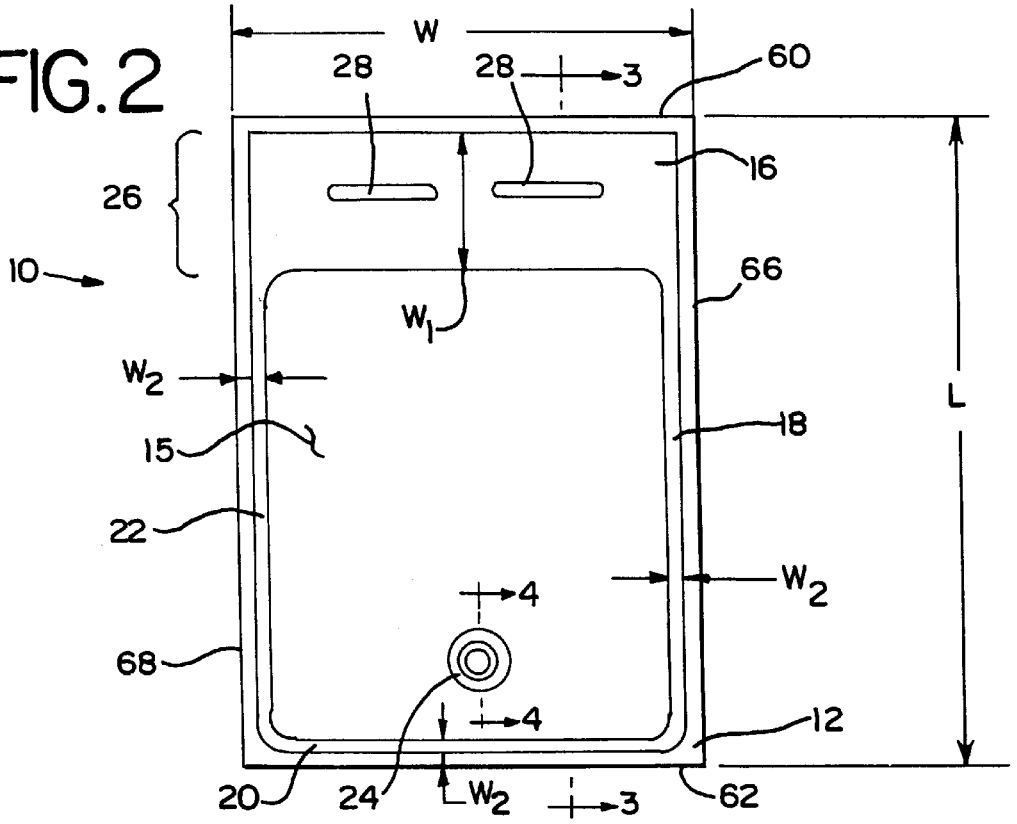
FIG. 2 is a front elevation view of the hangable bag of FIG. 1.
Figure 3:
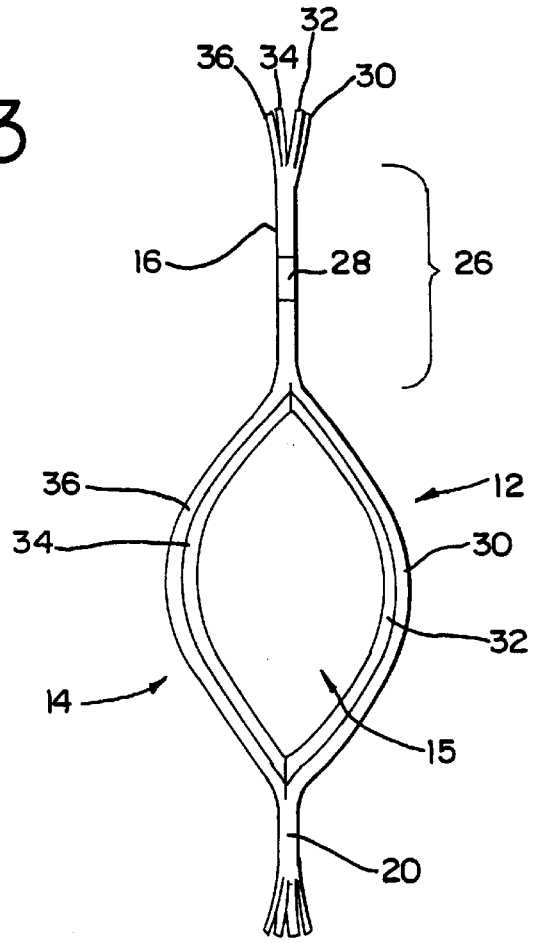
FIG. 3 is a cross-sectional view taken along line 3—3 of FIG. 2.

Referring now in detail to the Figures and initially to FIGS. 1–3, there is shown a preferred embodiment of a hangable bag 10 constructed in accordance with the present invention. The hangable bag 10 generally comprises four main components: a first or frontal panel 12, a second or rearward panel 14, a plurality of seal areas 16,18,20,22, and a spout 24. The frontal and rearward panels 12,14 form the pair of bag walls. At least one of the seal areas 16 forms a handle region 26. An aperture 28 extends through the handle region 26 for hanging or carrying the bag 10.

The frontal and rearward panels 12,14, also known as walls or bag walls, are made of a flexible plastic material capable of being heat sealed together. As shown in one of the preferred embodiments illustrated in FIG. 3, each of the frontal and rearward panels 12,14 are made of two layers or plies of material. The frontal panel 12 comprises first and second layers 30,32 of material, and the rearward panel 14 comprises third and fourth layers 34,36 of material. The first 30, second 32, third 34 and fourth layers 36 of material are individual and separate structures having a density respective of the specific material of that layer. Each layer of material 30,32,34,36 is made of a suitable flexible material which is preferable a transparent plastic material, such as polyolefin, polypropylene, polyvinyl chloride, polyethylene, polyester, nylon and the like, including co-extruded and laminated materials. The first 30 and fourth layers 36 of material form the outer layers of the bag, and the second 32 and third layers 34 of material form the inner layers of the bag. While the preferred embodiment incorporates two layers of material per wall, it is understood that a bag made in accordance with the teachings herein could have any number of layers, and most preferably contains from one to four plies of material per wall.

Figure 7:
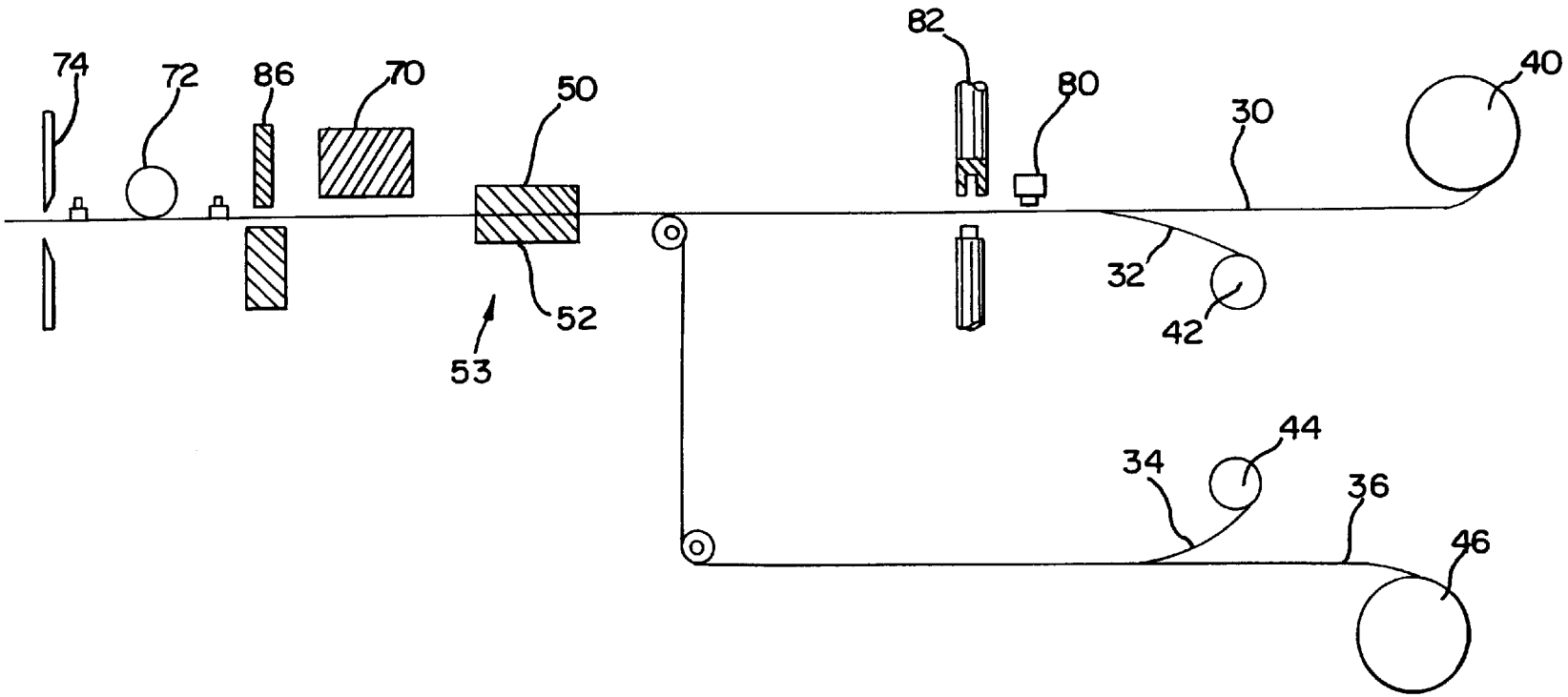

Each of the first, second, third, and fourth layers 30,32, 34,36 of material of the finished bag 10 have substantially the same length (L) and width (W) dimension, and are manipulated to be placed in registration with one another. During the manufacturing steps, as are shown in FIG. 7, individual bags 10 are manufactured in a seven step process: (1) punch 80 the opening 29 for the spout 24; (2) affix 82 the spout 24; (3) heat seal 53 the seal areas 16,18,20,22; (4) cool down at cooling station 70; (5) punch 86 the apertures 28; (6) slit the side-by-side bags at the slitting wheel 72; and, (7) cut off the individual bags with a knife 74. Separate rolls of material 40,42,44,46 provide the individual layers 30,32,34, 36 of the bag 10. The process provides for manufacturing two bags 10 simultaneously side-by-side. The two side-by-side bags are then slit apart as a final manufacturing process. Accordingly, the width (W) dimension of each bag 10 is approximately one-half of the width of the entire web of film, and the length (L) dimension is set by the cut-off length of each bag during a specific manufacturing run. While the manufacturing process described herein utilizes an intermittent motion machine having stamps or dies 50,52 to provide the seal areas 16,18,20,22, it is understood that a continuous motion machine, including those having rotary sealing mechanisms could also be employed.

Figure 4:
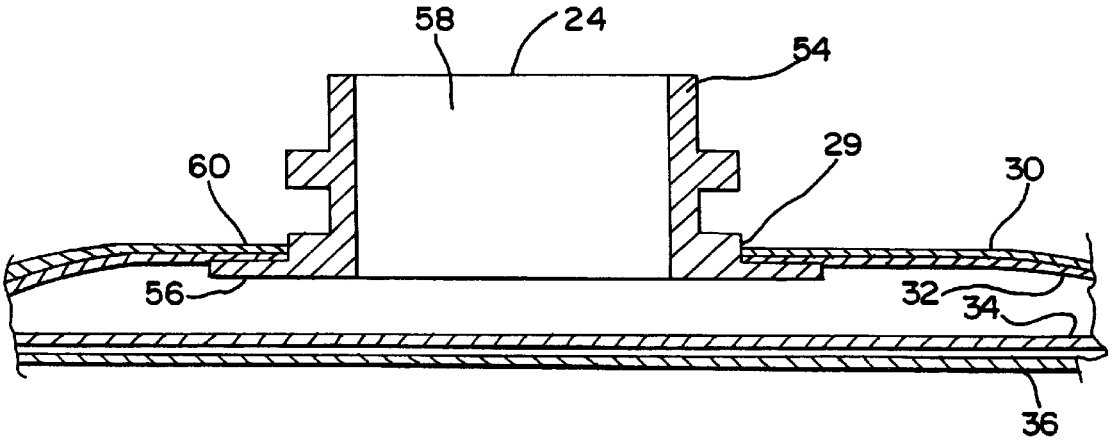
FIG. 4 is a cross-sectional view taken along line 4—4 of FIG. 2.

Continuous webs of material are unrolled in parallel from each of the first 40, second 42, third 44 and fourth rolls 46 to provide the first 30, second 32, third 34 and fourth layers 36 of the bag 10. The material is aligned and directed toward the machine. As a first manufacturing step, a corresponding aperture 29 or opening is punched through the frontal panel 12, that being both the first and second layers 30,32 of material. The openings 29 serve as a housing for the spout 24 of the bag. After the openings 29 are punched through the layers of the frontal panel, a spout 24 is positioned within the openings 29. The spout 24 has a cylindrical portion 54 at one end, and a flange portion 56 at the other end. The cylindrical portion 54 has an opening 58 therethrough having an inner diameter, and a longitudinal axis which extends through the center of the spout 24, from the cylindrical portion 54 through to the flanged portion 56. The flanged portion 56 of the spout is heat sealed to the first and second layers 30,32 adjacent the opening 29 such that the axis of the spout is substantially perpendicular to the bag walls 12,14. As is best shown in FIG. 4, the flange 56 has an first side 60 which contacts the inner side of the second layer 32 of material. Through heat and pressure, the first and second layers 30,32 of material are heat sealed or welded to the flange 56 to permanently affix the spout 24 in place. The spout 24 is preferable located toward the bottom of the bag 10 opposite the enlarged handle region 26, such that when a manufactured bag is hung, the product in the interior compartment 15 of the bag will naturally feed out via gravitational forces. The structure and functionality of the bag eliminates the need for a box, an evacuation channel, and a vacuum pump.

Once the spout 24 is affixed to the first and second layers 30,32 of material, the first, second, third and fourth webs 30,32,34,36 continue to the stamping station 53. The stamping station 53 is made of a die 50 having a die surface which defines the shape of the seal areas 16,18,20,22. The die surface is heated so as to maintain a temperature during pressing of the layers of material to form the seal areas. With the preferred process, a moving flat belt 52 is located opposite the die 50. The layers of material 30,32,34,36 travel on the upper surface of the flat belt 52, and the die 50 contacts the material, melting heat and pressure on the material to create the seal areas 16,18,20,22. Another process, however, includes using upper and lower, or male and female dies to create the seal areas.

At the stamping station 53 the first, second, third, and fourth layers 30,32,34,36 of material are heat sealed together at adjacent first, second, third, and fourth seal areas 16,18, 20,22 to form the bag walls 12,14 and an enclosed region 15 or interior compartment encapsulated or bounded by the adjacent seal areas. The enclosed region 15 is encapsulated between the second and third layers 32,34 of material on the top and bottom, and is bounded by the adjacent seal areas 16,18,20,22 at its periphery. As shown in FIG. 2, the outer periphery of the seal areas 16,18,20,22 is substantially adjacent the periphery of the individual plies of material 30,32,34,36. The opening 29 in the frontal panel 12, and subsequently the opening 58 in the spout 24, provide access to the enclosed region 15 of the bag 10. Depending on the size of the bag 10 being manufactured, the size of the enclosed region 15 may range from being able to contain approximately one-half of a liter of product, to being able to contain approximately five gallons of product or more.

In the preferred embodiments, the adjacent seal areas 16,18,20,22 are entirely integral with one another. Each of the seal areas 16,18,20,22 is formed of a continuous heat seal with the other seal areas. The configuration of the seal areas 16,18,20,22 is dependent on the configuration of the upper and lower stamps 50,52. As is shown in FIG. 2, the first seal area 16 is much larger than the second 18, third 20 and fourth 22 seal areas. The configuration of the interior periphery of the continuous seal areas forms the peripheral configuration of the interior compartment 15. While this disclosure refers to individual seal areas, it is understood that one overall continuous seal area is created, that seal area having distinct regions or portions (i.e., the first 16, second 18, third 20, and fourth 22 seal areas).

The seal areas include portions of the frontal 12 and rearward panels 14 (portions of the first 30, second 32, third 34, and fourth 36 layers of material) that are reformed into continuous and integral structures. Due to the joining of the individual layers of material 30,32,34,36 from the heat and pressure of the stamping dies 50,52, the integrated seal areas 16,18,20,22 are generally inseparable into their constituent layers 30,32,34,36 of material. Additionally, due to the heat and pressure which joins the multiple layers of material, the seal areas 16,18,20,22 have a density substantially greater than the density of the adjacent individual layers of material. The greater density provides the seal areas with increased rigidity over the non-sealed layers.

Figure 5:
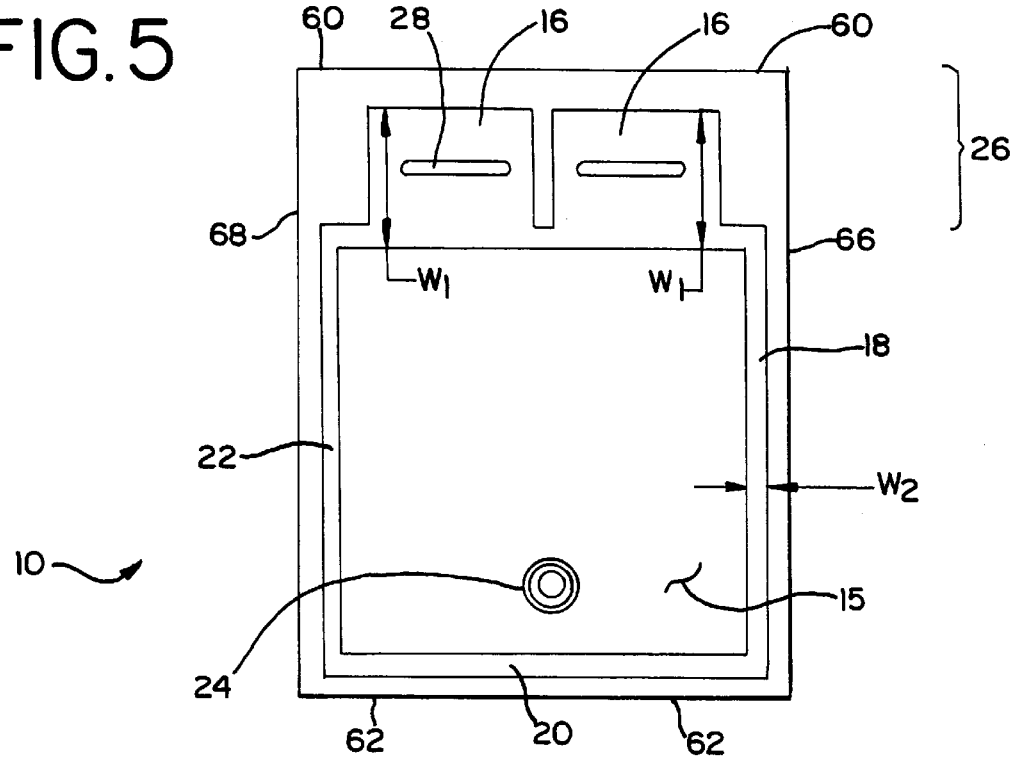
FIG. 5 is a front elevation view of another embodiment of the hangable bag of the present invention.
Figure 6:
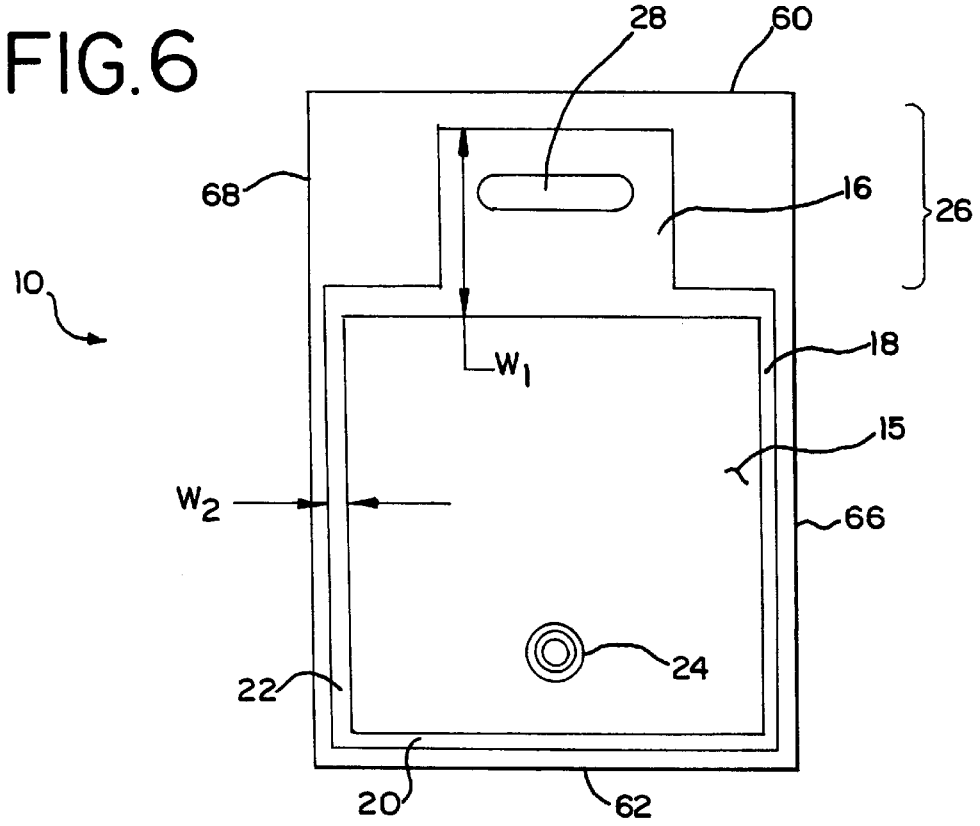
FIG. 6 is a front elevation view of another embodiment of the hangable bag of the present invention; and, FIG. 7 is a schematic showing a sequence of steps for making a hangable bag of the present invention.

As best illustrated in FIGS. 1 and 2, the first seal area 16 is adjacent the top 60 of the bag 10, and its opposing seal area, the third seal area 20 is adjacent the bottom 62 of the bag. Similarly, the second 18 and fourth seal 22 areas are adjacent the opposing sides 66,68 of the bag, respectively. Accordingly, the four heat seal areas 16,18,20,22 form an interior rectangle, with the outer periphery of the seal areas being substantially adjacent the periphery of the bag walls 12,14, and the inner periphery of the seal areas forming and being adjacent the periphery of the interior compartment 15. However, dependent on the configuration of the bag 10 and the interior compartment 15, the configuration of the seal areas will change accordingly. Specifically, the embodiments of FIGS. 5 and 6 provide similar strength characteristics as the embodiment illustrated in FIG. 2, however the embodiment shown in FIG. 5 includes two first seal areas 16. Each of the first seal areas 16 in FIG. 5 are proximal each of the respective apertures 28. Unlike the embodiments illustrated in FIGS. 2 and 5, the embodiment shown in FIG. 6 has only one aperture 28, and the first seal area 16 is proximal the aperture 28 without extending to substantially adjacent each of the opposing sides 66,68 of the bag.

In FIG. 2, the first seal area 16 extends opposite the enclosed region 15 toward the top 60 of the bag to form the handle region 26. A portion of the first seal area 16 has an enlarged width ($W_1$), while the other seal areas 18,20,22 generally have a constant width ($W_2$). Width $W_1$ is substantially greater than width $W_2$. In the embodiment shown in FIGS. 1 and 2, width $W_1$ is approximately 2.50", and width $W_2$ is approximately 0.25". The increased width of $W_1$ is required to provide a handle region 26 with substantially increased strength and rigidity for hanging and carrying the bag 10. Accordingly, it has been found that on the high end the ratio of $W_1/W_2$ should be no more than 30, and on the low end the ratio of $W_1/W_2$ should be no less than 2, depending on the thickness of the layers of material and the amount of product to be contained in the interior compartment.

After the heat seals 16,18,20,22 are formed in the stamping process, the heat-sealed bags are transferred to a cooling station 70 to cool the heat seals. It has been found that rapid cooling of the heat seals, as opposed to seals which are air cooled, forms seals with increased strength.

Next, handles or apertures 28 are punched in the first seal area 16 (i.e., the handle region 26) for supporting the hangable bag 10. The apertures 28 provide a means for hanging or supporting the bag, and for carrying the bag. The apertures 28 are located between a periphery of the top 60 of the bag and a periphery of the interior compartment 15. Preferably, two handles or apertures 28 are punched in the enlarged handle region 26 to provide for more uniform hanging of the bag. By increasing the number of hanging apertures, the weight of the product in the bag is dispersed evenly between each aperture. As such, the width $W_1$ of the first seal area 16 can be decreased as the number of apertures 28 increases. The hangable bag can then be hung on horizontally extending arms or hangers.

After the apertures 28 are punched in the rigid handle region 26, the side-by-side bags are separated from each other by a slitting wheel 72. As such, two rows of bags exit from the slitter. Next, a knife 74 is used to separate the trailing end 62 (i.e., the bottom of each bag) of each bag from the leading end 60 (i.e., the top of each bag) of the next successive bag being manufactured for both rows of bags. When the bags exit from this step, two individual bags, one being next to the other, are completed.

While the specific embodiments have been illustrated and described, numerous modifications come to mind without significantly departing from the spirit of the invention, and the scope of protection is only limited by the scope of the accompanying claims.

We claim:

1. A hangable bag for use in containing and dispensing a product comprising:

a frontal panel comprising first and second independent layers of material, a rearward panel comprising third and fourth independent layers of material, wherein the frontal panel and the rearward panel are heat sealed together at adjacent seal areas to form an enclosed region bounded by adjacent seal areas, wherein the seal areas include portions of the frontal and rearward panels that are bonded together, and wherein the frontal panel has an opening to provide access to the enclosed region;

a spout sealed to the frontal panel over the opening;

a portion of a first of the seal areas extending opposite the enclosed region a distance substantially greater than one of the other seal areas to form a handle region; and, an aperture through the handle region, the aperture providing a means for hanging the hangable bag, wherein a portion of the first of the seal areas has a width ($W_1$) and at least one of the other seal areas has a width ($W_2$), and wherein the ratio of $W_1/W_2$ is in the range of 20 to 2.

2. The hangable bag of claim 1, wherein the first, second, third, and fourth layers are individual and separate structures, and wherein the seal areas include portions of the first, second, third, and fourth layers of material reformed into structures being generally inseparable into their constituent layers, the seal areas having a density substantially greater than the density of the adjacent individual layers.

3. The hangable bag of claim 1, wherein the enlarged width ($W_1$) of the first of the seal areas is adapted to provide additional strength and rigidity to the handle region of the hangable bag.

4. The hangable bag of claim 1, wherein the seal areas are integral with each other.

5. The hangable bag of claim 1, further comprising four seal areas, the first of the seal areas having a width ($W_1$) and the other of the seal areas having a width ($W_2$), and wherein $W_1$ is substantially greater than $W_2$.

6. The hangable bag of claim 1, wherein the enclosed region is adapted to contain at least one-half of a liter of liquid.

7. The hangable bag of claim 1, wherein the frontal and rearward panels are made of a flexible plastic material capable of being heat sealed to one another.

8. The hangable bag of claim 1, further comprising a second aperture through the handle region, the first and second apertures providing a means for uniformly hanging the hangable bag.

9. A hangable bag for use in containing and dispensing a liquid comprising:

a pair of bag walls beat sealed together adjacent their peripheries to form a bag having an interior compartment surrounded by continuous heat seals, the heat seals having a width ($W_2$), wherein at least one of the pair of bag walls comprises a plurality of independent layers of material;

a spout heat sealed to one of the bag walls, the spout having an axis and a spout opening therethrough, wherein the axis of the spout is substantially perpendicular to the bag walls, and wherein the spout opening provides access to the interior compartment;

an enlarged heat-sealed handle region extending continuously from and integral with one of the heat seals, wherein the handle region has an opening therein located between a periphery of the bag and a periphery of the interior compartment for supporting the hangable bag, wherein the handle region has a width ($W_1$) between the periphery of the bag and the aperture, and wherein the ratio of $W_1/W_2$ is in the range of 20 to 2.

10. The hangable bag of claim 9, wherein the enlarged heat-sealed handle region has a width ($W_1$), and wherein the other heat seal regions have a width ($W_2$).

11. The hangable bag of claim 10, wherein the ratio of $W_1/W_2$ is in the range of 20 to 2.

12. The hangable bag of claim 9, wherein the enlarged heat-sealed handle region has a substantially greater rigidity than the other heat seals.

13. The hangable bag of claim 9, wherein a first of the pair of bag walls comprises first and second substantially separate layers of material, and wherein a second of the pair of bag walls comprises third and fourth substantially separate layers of material.

14. The hangable bag of claim 13, wherein the interior compartment has two walls formed by the second and third layers of material.

15. The hangable bag of claim 9, further comprising a pair of openings in the handle region, each of the openings disposed between a periphery of the bag and a periphery of the interior compartment.

16. A hangable bag for use in containing and dispensing a liquid comprising:

a frontal wall of first and second plies of material, wherein the first and second plies of material have hole therethrough, and wherein the first ply of material has a portion thereof that is separate from the second ply of material;

a rearward wall of third and fourth plies of material, wherein the third ply of material has a portion thereof that is separate from the fourth ply of material the first and second plies of the frontal wall being heat sealed to the third and fourth plies of the rearward wall at first, second, third and fourth seal areas adjacent the peripheries of the first, second, third and fourth plies, wherein the layers of material at the first, second, third and fourth seal areas are substantially reformed into an integrated structure generally inseparable into its constituent layers, the first, second, third and fourth seal areas thereby encapsulating an interior compartment between the second and third plies of material, and wherein the first seal area has a width ($W_1$) and the second, third and fourth seal areas have a width ($W_2$), $W_1$ being substantially greater than $W_2$ such that the ratio of $W_1/W_2$ is in the range of 20 to 2, and wherein each of the seal areas is formed integral with the adjacent seal areas;

first and second handles in the first seal area for supporting the hangable bag, the first and second handles disposed substantially between a periphery of the interior compartment and a top periphery of the hangable bag, a spout heat sealed to the first and second plies of material adjacent the hole in the first and second plies of material, the spout providing an opening to the interior compartment.

17. The hangable bag of claim 16, wherein $W_1$ is approximately 2" and $W_2$ is approximately 0.2".

18. The hangable bag of claim 16, wherein interior compartment is adapted to contain at least one-half of a liter of liquid.

19. The hangable bag of claim 16, wherein the first, second, third and fourth plies of material are a flexible plastic heat-sealable material.

* * * * *

UNITED STATES PATENT AND TRADEMARK OFFICE

CERTIFICATE OF CORRECTION

PATENT NO. : 6,200,300 B1
DATED : March 13, 2001
INVENTOR(S) : Paul F. Petriekis, et al.

It is certified that error appears in the above-identified patent and that said Letters Patent is hereby corrected as shown below:

Column 7,
Line 34, delete the word "beat" and insert therefor -- heat --

Column 8,
Line 23, after the word "material" and before the word "the" insert -- , --.

Column 9,
Line 46, after the word "bag:" delete the "," and insert therefor -- ; and, --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*